US011766710B1

(12) United States Patent
Luo

(10) Patent No.: US 11,766,710 B1
(45) Date of Patent: Sep. 26, 2023

(54) MULTI-SIZE ADJUSTABLE MOUTH EXPANDING DEVICE

(71) Applicant: Guofen Luo, Dongguan (CN)

(72) Inventor: Guofen Luo, Dongguan (CN)

( * ) Notice: Subject to any disclaimer, the term of this patent is extended or adjusted under 35 U.S.C. 154(b) by 0 days.

(21) Appl. No.: 17/860,106

(22) Filed: Jul. 8, 2022

(51) Int. Cl.
*B21D 41/02* (2006.01)

(52) U.S. Cl.
CPC ..... *B21D 41/023* (2013.01)

(58) Field of Classification Search
CPC .... B21D 41/023; B21D 41/021; B21D 41/02; B21D 41/026; B21D 41/028; B21D 39/08; B21D 39/10; B21D 19/02; B21D 19/04; B21D 19/046; B29C 57/02; B29C 57/04
See application file for complete search history.

(56) References Cited

U.S. PATENT DOCUMENTS

| | | | | |
|---|---|---|---|---|
| 893,484 | A * | 7/1908 | Brinkman | 220/802 |
| 2,940,502 | A * | 6/1960 | La Martine | B21D 17/04 72/82 |
| 5,531,370 | A * | 7/1996 | Rohrberg | B23D 21/14 72/126 |
| 7,997,112 | B2 * | 8/2011 | Sandman | F24F 13/0209 72/460 |

* cited by examiner

*Primary Examiner* — Teresa M Ekiert

(57) ABSTRACT

A multi-size adjustable mouth, expanding device comprises a machine frame; a lower spindle module having s a lower spindle and a first gear, the periphery of the front end of the lower spindle is configured with a mouth expanding convex ring to enlarge the tube mouth; an upper spindle module, which includes an upper spindle, a second gear, and an expanding concave wheel, the upper spindle front end is mounted on the front end of the machine frame in a form that it can be displaced upward and downward, the periphery of the expanding concave wheel is configured with a mouth expanding groove, and the mouth expanding groove is placed on the upper side of the mouth expanding convex ring; a driving device, which is connected on the rear end of the lower spindle, and which is used to drive the lower spindle to rotate.

10 Claims, 6 Drawing Sheets

MULTI-SIZE ADJUSTABLE MOUTH EXPANDING DEVICE

BACKGROUND OF INVENTION

1. Field of the Invention

The present invention relates generally to the technical field of mouth expansion of tubular products, and more particularly to an adjustable mouth expanding device that is adaptable to different tube sizes.

2. Description of Related Art

A tube expanding machine is mainly used to enlarge the diameter of the interface of tubular product (such as a copper tube), and to produce a flaring for connection of tubular products. The flaring can have two different shapes: trumpet shape and cup shape.

In the conventional technique, a conic head is manually inserted into the tube mouth, and then the operator hits the conic head using a tool to enlarge the mouth. This traditional method is difficult and costs a lot of time and effort. It is of low efficiency and may easily cause damage of the tube mouth.

Later, the market has seen a processing machine to enlarge the mouth of a tubular product. This mouth expanding machine can speed up the processing of tubular products and greatly improve the efficiency. However, to meet the requirement for bulk processing of tubular products, this traditional machine has a uniform design, and its size is fixed. Therefore, it is not convenient for processing tubular products of different sizes and models. Its adaptability is not very good. If the expansion is done forcibly, the mouth of the tubular product may easily be damaged, leading to economic loss. Therefore, it cannot meet the current manufacturing requirement.

In view of this, the present invention provides the following technical solution.

SUMMARY OF THE INVENTION

The purpose of the present invention is to overcome the deficiencies of the prior art and provide a multi-size adjustable mouth expanding device.

In order to solve the above-mentioned technical problems, the present invention adopts the following technical solutions:

A multi-size adjustable mouth expanding device, comprising: a machine frame; a lower spindle module, including a lower spindle sleeved inside a lower part of the machine frame, and a first gear sleeved on the lower spindle, wherein, a front end and rear end of the lower spindle are respectively extended out of a front end face and rear end face of the machine frame, and the periphery of a front end of the lower spindle is configured with a mouth expanding convex ring used to expand the tube mouth; an upper spindle module including an upper spindle, a second gear sleeved on a periphery of the upper spindle and meshed with the first gear, and an expanding concave wheel installed on the front end of the upper spindle and positioned out of the front end face of the machine frame, wherein, the rear end of the upper spindle is installed on the rear end of the machine frame in a rotary form, the front end of the upper spindle is installed on the front end of the machine frame in a form that it can be displaced upward or downward, the periphery of the expanding concave wheel is configured with a mouth expanding groove, the mouth expanding groove is positioned above the mouth expanding convex ring; a driving device connected on the rear end of the lower spindle, and is used to drive the lower spindle to rotate.

More particularly, wherein, the front and rear ends of the lower spindle are respectively sleeved with a first spindle seat and a second spindle seat, the first spindle seat and second spindle seat are both fixed inside the machine frame through screws, and the lower spindle can rotate both around the first spindle seat and the second spindle seat.

More particularly, the mouth expanding convex ring is integrally formed around the front end of the lower spindle.

More particularly, wherein, the front and rear ends of the upper spindle are respectively sleeved with a third spindle seat and a fourth spindle seat, specifically, the fourth spindle seat is installed on the rear end of the machine frame in a rotary form; the third spindle seat is installed on the front end of the machine frame through an adjusting module in a form that it can be displaced upward or downward.

More particularly, wherein the fourth spindle seat is sleeved with a rotary shaft, and through the rotary shaft, it is installed on the rear end of the machine frame in a rotary form.

More particularly, wherein, the adjusting module comprises a threaded seat fixed on the machine frame, an adjusting screw rod spirally going through the threaded hole of the threaded seat, an adjusting handle fixed on the upper end of the adjusting screw rod, and a spring configured between the lower end face of the third spindle seat and the upper end face of the first spindle seat, under the elastic force of the spring, the third spindle seat is lifted upward, and the lower end of the adjusting screw rod is pressed on the upper end face of the third spindle seat.

More particularly, wherein, the spring is a tower-shaped spring with its diameter increasing from top to bottom; the first spindle seat is internally configured with a first copper sleeve; the lower spindle is sleeved inside the first copper sleeve and can rotate inside the first copper sleeve; the third spindle seat is internally configured with a second copper sleeve; the upper spindle is sleeved inside the second copper sleeve and can rotate inside the second copper sleeve.

More particularly, wherein, the lower end face of the third spindle seat is configured with a first groove body; the upper end face of the first spindle seat is configured with a second groove body; the lower end of the spring is embedded into the second groove body; the upper end of the spring is embedded into the first groove body.

More particularly, wherein, the driving device comprises a handle, the handle is fixed on the rear end of the lower spindle, which can be turned manually to drive the lower spindle to rotate; the lower end of the machine frame is configured with a mounting board protruding downward for fixed installation in the environment.

More particularly, the driving device is a motor module, which electrically drives the lower spindle to rotate; the lower end of the machine frame is configured with a mounting board protruding downward for fixed installation in the environment, Comparing with the prior art, the present invention provides the following advantages and benefits:

When using the present invention, the height of the upper spindle front end is adjusted upward to enlarge the gap between the expanding concave wheel of the upper spindle front end and the mouth expanding convex ring of the lower spindle front end. Then, put the tubular products (copper tube) on the periphery of the lower spindle front end, and between the mouth expanding convex ring and the expanding concave wheel, so that the mouth expanding convex ring and the expanding concave wheel respectively clamp the outer wail and inner wail of the tube mouth of the tubular product (such as a copper tube). Then, the height of the upper spindle front end is adjusted downward, so that the tubular product (such as a copper tube) is clamped tightly, and the tube mouth of the tubular product (such as a copper tube) is expanded and deformed outward. In the end, the driving device drives the lower spindle of the lower spindle module to rotate. During rotation of the lower spindle, the first gear works with the second gear to drive the upper spindle to rotate simultaneously. Thus, the mouth expanding convex ring presses the tube mouth of the tubular product (such as a copper tube) outward into the mouth expanding groove on the periphery of the expanding concave wheel, and the tube mouth is enlarged. After continuous rotation of the mouth expanding convex ring and the expanding concave wheel, the tube mouth of the tubular product (such as a copper tube) is continuously squeezed, deformed, and expanded. The tubular product will not be damaged, and the quality of the flaring is guaranteed, meeting the current manufacturing requirement. With a simple structure and a small size, the present invention can be transported and operated conveniently. It can be used for mouth expansion of tubular products of different sizes and models. Its adaptability is very good. Its multi-size adjustment and operational convenience will make it very competitive in the market.

DETAILED DESCRIPTION OF THE INVENTION

Figure 1:
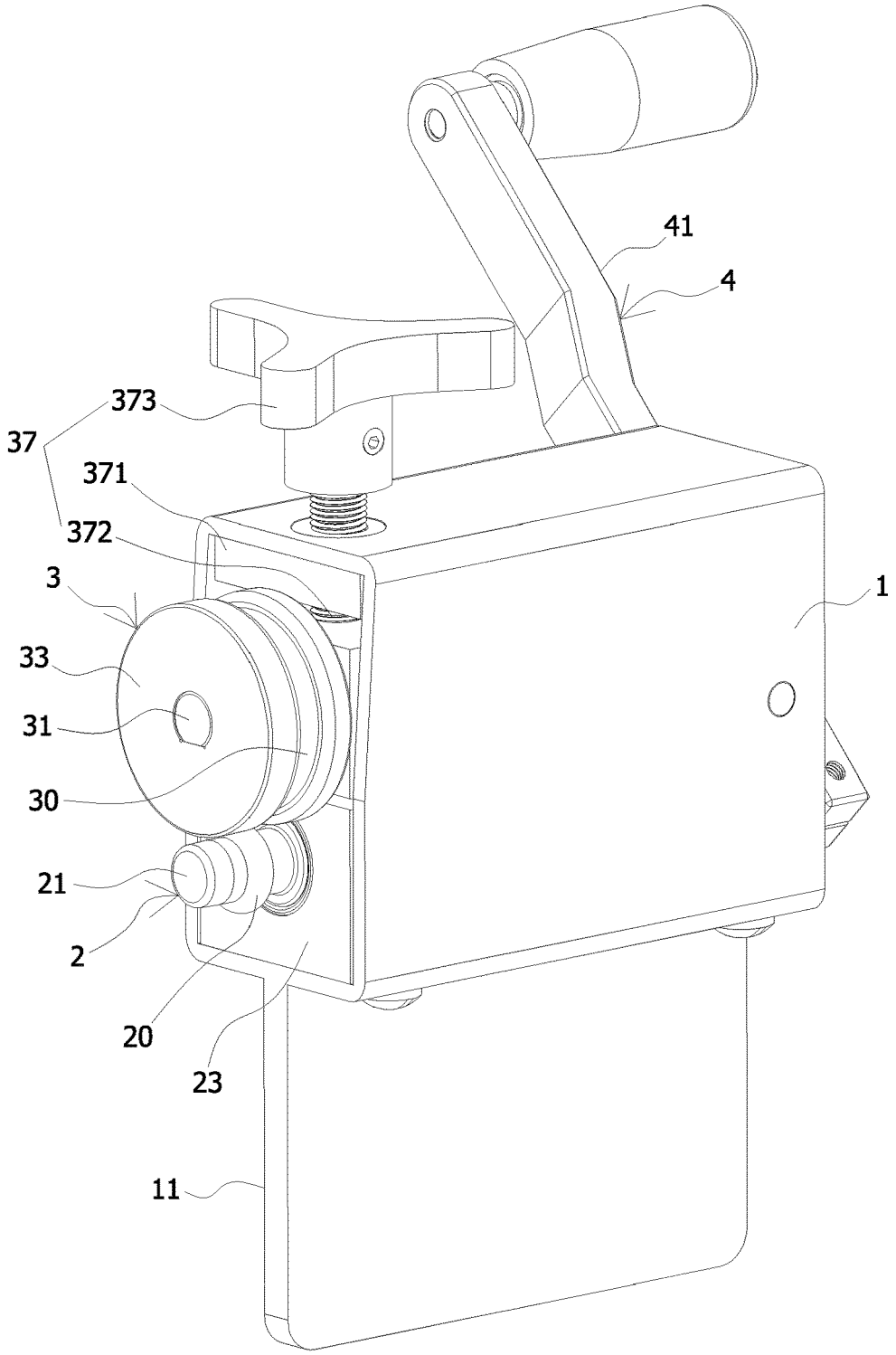
FIG. 1 is a perspective view of the present invention.
Figure 2:
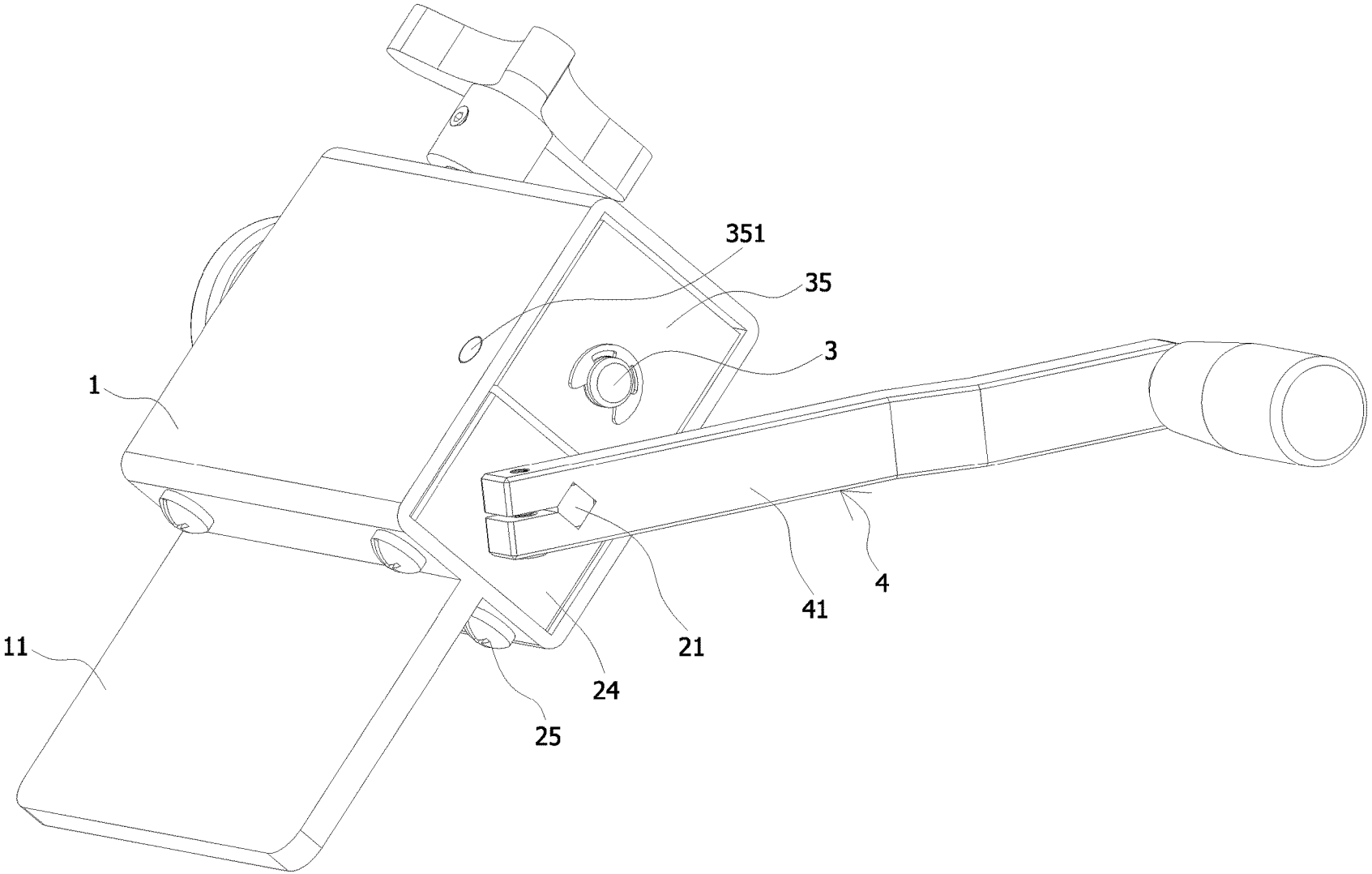
FIG. 2 is a perspective view of the present invention from another angle.
Figure 3:
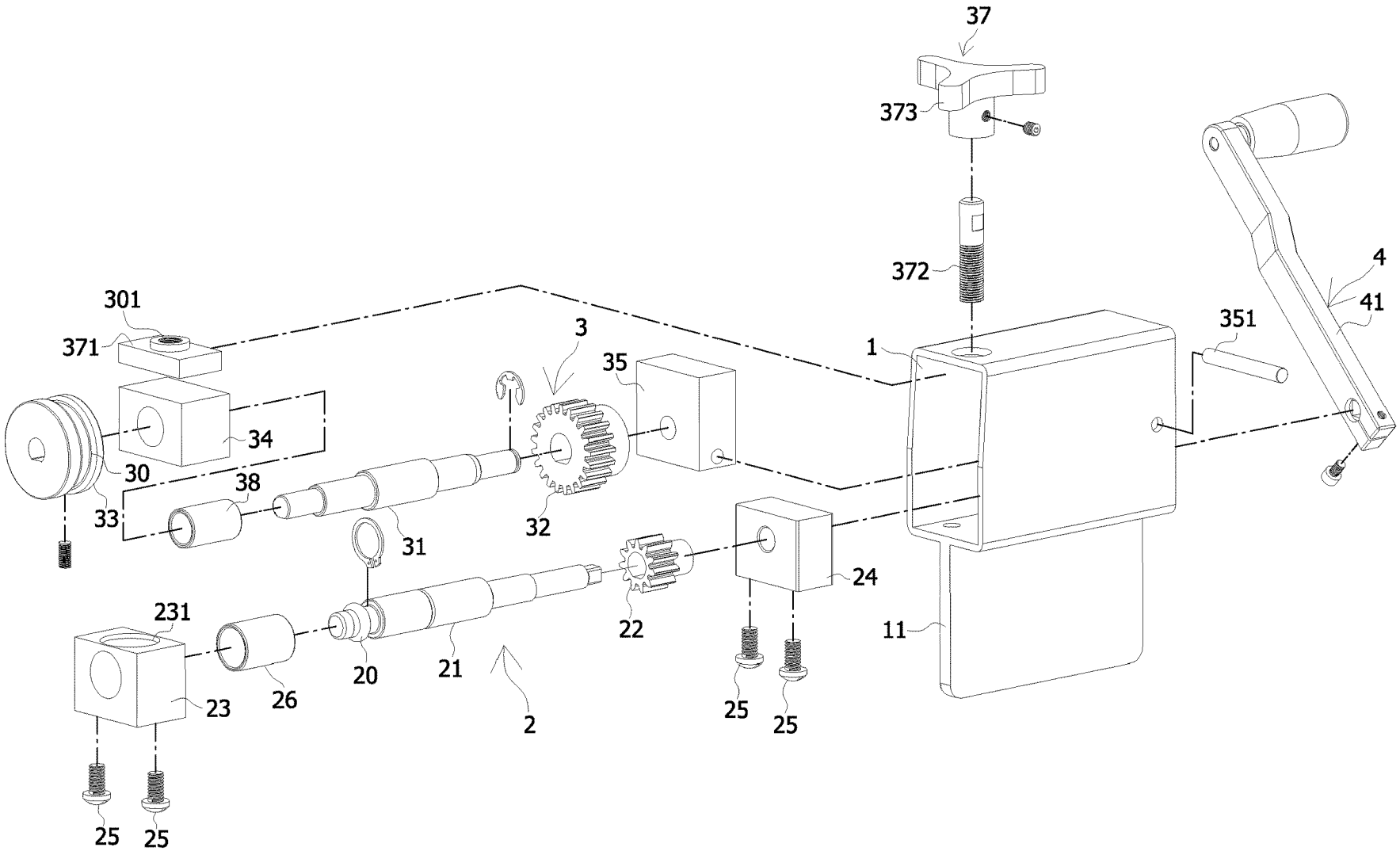
FIG. 3 is an exploded view of the present invention.
Figure 4:
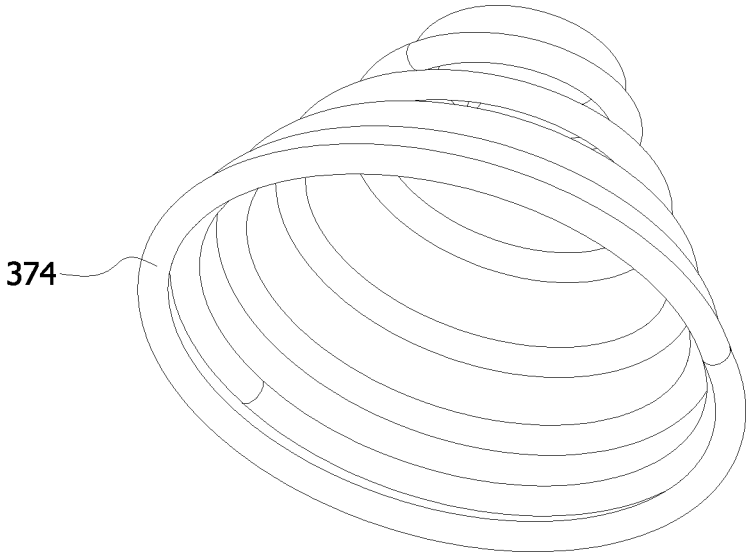
FIG. 4 is a perspective view of the spring in the present invention.
Figure 5:
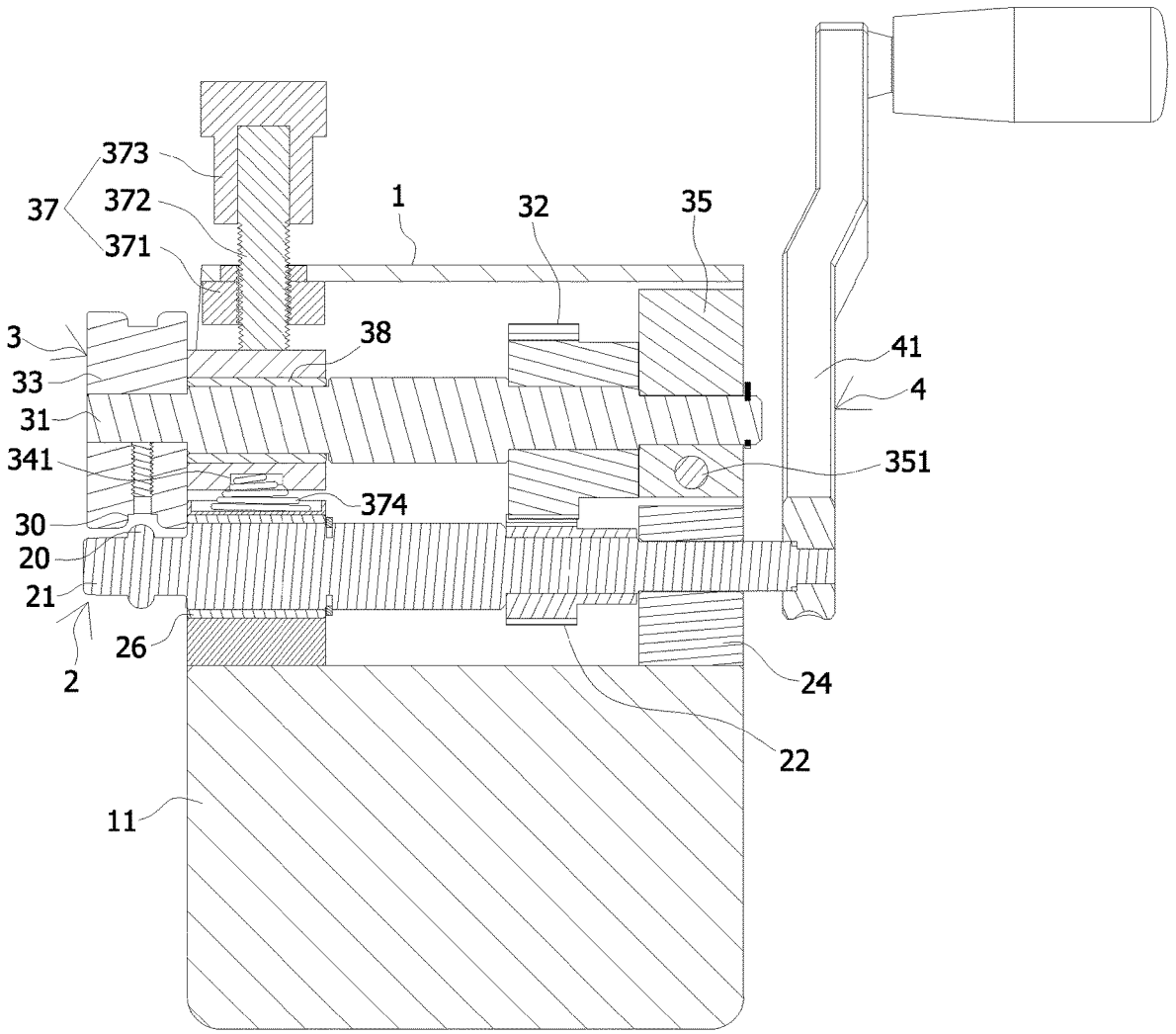
FIG. 5 is a sectional view of the present invention.
Figure 6:
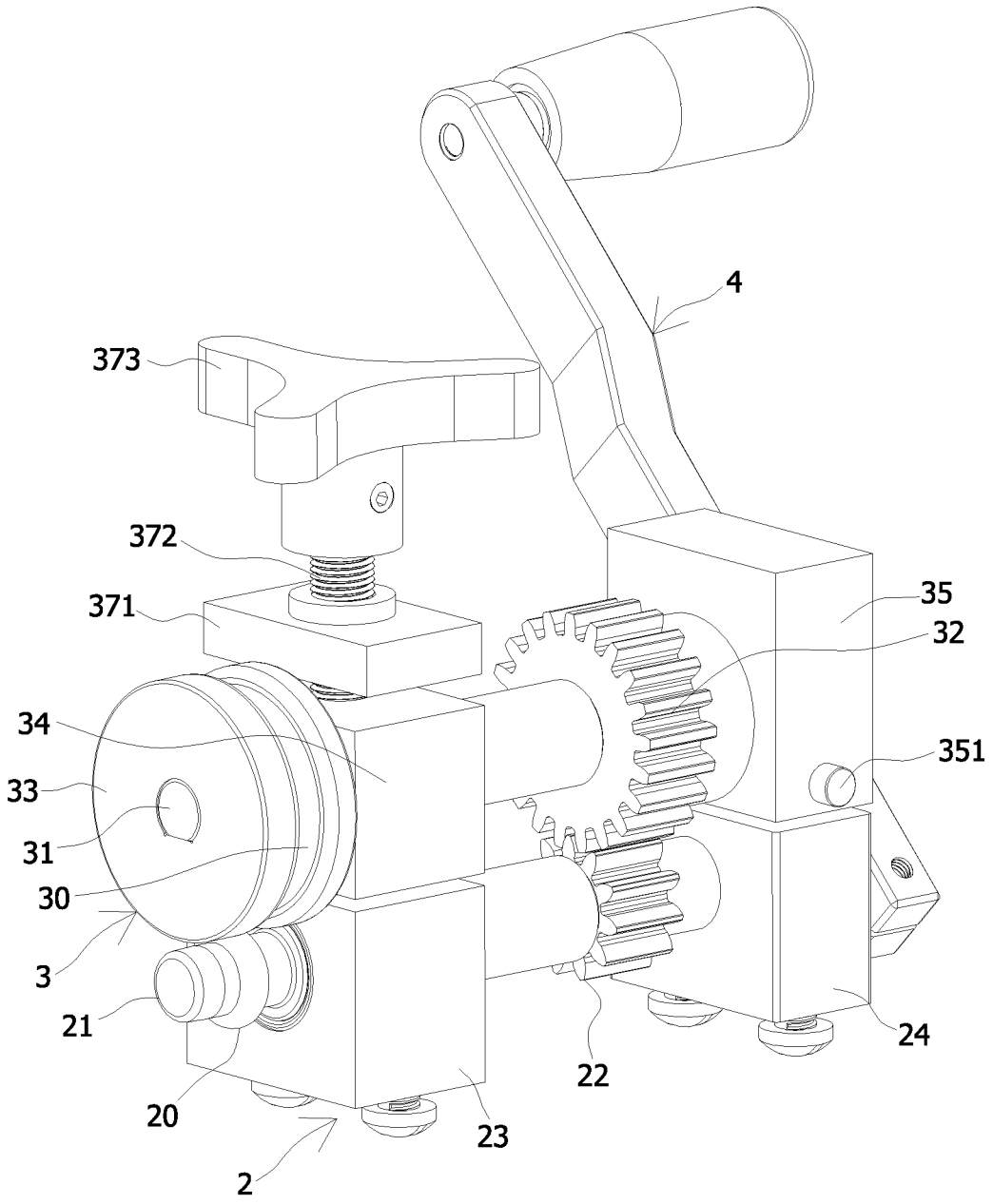
FIG. 6 is a perspective view of the invention after removing the machine frame.

Depicted in FIGS. 1-6 is a multi-size adjustable mouth expanding device, which comprises: a machine frame 1, a lower spindle module 2 configured inside the machine frame 1, an upper spindle module 3 and a driving device 4, wherein, the lower spindle module 2 and the upper spindle module 3 are connected and can move simultaneously, the driving device 4 is configured outside the machine frame 1, and is connected to the lower spindle module 2, the driving device 4 is used to drive the lower spindle module 2 to rotate, when the lower spindle module 2 rotates, it will drive the upper spindle module 3 to rotate simultaneously, to facilitate stable expansion of the tube mouth of the tubular product (such as a copper tube) later.

The lower end of the machine frame 1 is configured with a mounting board 11 protruding downward for fixed installation in the environment. Before usage, the mounting board 11 is installed on the workbench by insertion, and is tightly fixed. Of course, it can be locked by a screw, so that it is installed on the workbench more stably.

The lower spindle module 2 comprises a lower spindle 21 sleeved inside the lower part of the machine frame 1 and a first gear 22 configured on the lower spindle 21, the front end and the rear end of the lower spindle 21 are respectively extended out of the front end face and rear end face of the machine frame 1, and the periphery of the front end of the lower spindle 21 is con figured with a mouth expanding convex ring 20 to enlarge the mouth; the upper spindle module 3 comprises an upper spindle 31, a second gear 32 which is sleeved on the periphery of the upper spindle 31 and meshes the first gear 22, and an expanding concave wheel 33 installed on the front end of the upper spindle 31 and positioned outside the front end face of the machine frame 1. The upper spindle 31 rear end is installed on the rear end of the machine frame 1 in a rotary form. The front end of the upper spindle 31 is installed on the front end of the machine frame 1 in a form that it can be adjusted and displaced upward or downward. The periphery of the expanding concave wheel 33 is configured with a mouth expanding groove 30. The mouth expanding groove 30 is positioned above the mouth expanding convex ring 20. The driving device 4 is connected on the rear end of the lower spindle 21, and is used to drive the lower spindle 21 to rotate.

When using the present invention, the height of the front end of the upper spindle 3 l is adjusted upward, so that the gap between the expanding concave wheel 33 on the front end of the upper spindle 31 and the mouth expanding convex ring 20 on the front end of the lower spindle 21 becomes bigger. Now, the tubular product (such as a copper tube) is sleeved on the periphery of the front end of the lower spindle 21, and positioned between the mouth expanding convex ring 20 and the expanding concave wheel 33, so that the mouth expanding convex ring 20 and the expanding concave wheel 33 respectively clamp the outer wall and inner wall of the tube mouth of the tubular product (such as a copper tube). Then, the height of the front end of the upper spindle 31 is adjusted downward to tightly clamp the tubular product (such as a copper tube), and further to expand and deform the tube mouth of the tubular product (such as a copper tube) outward. At last, the driving device 4 drives the lower spindle 21 of the lower spindle module 2 to rotate. As the first gear 22 meshes the second gear 32, when the lower spindle 21 rotates, it will drive the upper spindle 31 to rotate simultaneously. Thus, through the mouth expanding convex ring 20, the tube mouth of the tubular product (such as a copper tube) is pressed outward and into the mouth expanding groove 30 on the periphery of the expanding concave wheel 33, thus realizing expansion of the tube mouth. After continuous rotation of the mouth expanding convex ring 20 and the expanding concave wheel 33, the tube mouth of the tubular product (such as a copper tube) is continuously squeezed, deformed, and expanded, without damaging the tubular product. Thus, the quality of the flaring is guaranteed to meet the current manufacturing requirement. Furthermore, the present features a simple structure and a small size. It can he transported and operated easily. The height of the front end of the upper spindle 31 can be adjusted, so as to adjust the size of the gap between the expanding concave wheel 33 and the mouth expanding convex ring 20. Thus, it can be used for mouth expansion of tubular products of different sizes. Its high adaptability to different tube sizes provides great convenience and will make it very competitive in the market.

Below is a further description of the assembly of the lower spindle 21 and the machine frame 1. The lower spindle 21 the front and rear ends are respectively sleeved with a first spindle seat 23 and second spindle seat 24. The lower spindle 21 can rotate around both the first spindle seat 23 and the second spindle seat 24. The first spindle seat 23 and the second spindle seat 24 are both fixed inside the machine frame 1 through screws 25, so that the lower spindle 21 is stably installed inside the machine frame 1. The front and rear ends of the lower spindle 21 are both extended out of the front and rear end faces of the machine frame 1. Specifically, in order for the lower spindle 21 to rotate more stably and smoothly, the first spindle seat 23 is internally configured with a first copper sleeve 26; the lower spindle 21 is sleeved inside the first copper sleeve 26 and can rotate inside the first copper sleeve 26; of course, the second spindle seat 24 can also be internally configured with a third copper sleeve; the lower spindle 21 is sleeved inside the third copper sleeve and can rotate inside the third copper sleeve. In addition, the first copper sleeve and the third copper sleeve can be replaced by bearings, so that the lower spindle 21 can rotate more stably and smoothly.

The lower spindle 21 is a metal component. The mouth expanding convex ring 20 is integrally formed on the periphery of the front end of the lower spindle 21, so that the mouth expanding convex ring 20 and the lower spindle 21 are connected stably. As the mouth expanding convex ring 20 will not fall apart from the lower spindle 21, the assembled structure is more stable.

Below is a further description of the assembly of the upper spindle 31 and the machine frame 1. The front and rear ends of the upper spindle 31 are respectively sleeved with a third spindle seat 34 and a fourth spindle seat 35, wherein, the fourth spindle seat 35 is installed on the rear end of the machine frame 1 in a rotary manner; the third spindle seat 34 is installed on the front end of the machine frame 1 through the adjusting module 37 in a form that it can be displaced upward or downward, so that the front end of the upper spindle 31 can swing upward or downward. In this way, the height of the front end of the upper spindle 31 can be adjusted later through the adjusting module 37, so as to adjust the size of the gap between the expanding concave wheel 33 and the mouth expanding convex ring 20 to meet different usage needs.

The fourth spindle seat 35 is sleeved with a rotary shaft 351, and is installed on the rear end of the machine frame 1 rear end through the rotary shaft 351 in a rotary form, so that the front end of the upper spindle 31 can swing upward or downward.

Specifically, in order for the upper spindle 31 to rotate more stably and smoothly, the third spindle seat 34 is internally configured with a second copper sleeve 38; the upper spindle 31 is sleeved inside the second copper sleeve 38 and can rotate inside the second copper sleeve 38. Of course, the fourth spindle seat 35 can be internally configured with a fourth copper sleeve; the upper spindle 31 is sleeved inside the fourth copper sleeve and can rotate inside the fourth copper sleeve. In addition, the second copper sleeve and the fourth copper sleeve can be replaced by bearings.

The adjusting module 37 comprises a threaded seat 371 fixed on the machine frame 1, an adjusting screw rod 372 spirally going through the threaded hole 301 of the threaded seat 371, an adjusting handle 373 fixed on the upper end of the adjusting screw rod 372, and a spring 374 positioned between the lower end face of the third spindle seat 34 and the upper end face of the first spindle seat 23. The third spindle seat 34 is pushed upward by the elastic force of the spring 374, and the lower end of the adjusting screw rod 372 is pressed on the upper end face of the third spindle seat 34. When operating the adjusting module 37, the adjusting handle 373 is turned to drive the adjusting screw rod 372 to rotate in relation to the threaded hole 301 of the threaded seat 371, so as to realize stable lifting or lowering, and to press the third spindle seat 34 downward. Specifically, when the adjusting screw rod 372 rises continuously, the third spindle seat 34 is pushed upward by the elastic force of the spring 374. Thus, the height of the front end of the upper spindle 31 is adjusted upward; when the adjusting screw rod 372 descends continuously, the third spindle seat 34 will overcome the elastic force of the spring and be lowered to compress the spring 374. Thus, the mouth expanding convex ring 20 and the expanding concave wheel 33 respectively clamp the outer wall and inner wall of the tube mouth of the tubular product (such as a copper tube), and tightly clamp the tube mouth of the tubular product. Later, the mouth expanding convex ring 20 and the expanding concave wheel 33 turns simultaneously, and the tube mouth of the tubular product is continuously expanded to form a flaring.

The spring 374 is a tower-shaped spring with its diameter increasing from top to bottom. Such a structure will make the installation and the elastic force more stable. Specifically, the lower end face of the third spindle seat 34 is configured with a first groove body 341; the upper end face of the first spindle seat 23 is configured with a second groove body 231; the lower end of the spring 374 is embedded into the second groove body 231, the upper end of the spring 374 is embedded into the first groove body 341, so that the spring 374 is stably fitted between the third spindle seat 34 and the first. spindle seat 23.

The driving device 4 at least comprises two types:

The first type: The driving device 4 comprises a handle 41, the handle 41 is fixed on the rear end of the lower spindle 21, and can be manually turned to drive the lower spindle 21 to rotate.

The second type: The driving device 4 is a motor module, which drives the lower spindle 21 to rotate in an electrical manner.

The present invention adopts the first type described above. The driving device 4 comprises a handle 41, the handle 41 is fixed on the rear end of the lower spindle 21, and can be manually turned to drive the lower spindle 21 to rotate.

In summary, when using the present invention, the front end of the upper spindle 31 is adjusted upward to increase the height, so that the gap between the expanding concave wheel 33 on the front end of the upper spindle 31 and the mouth expanding convex ring 20 on the front end of the lower spindle 21 becomes bigger. Now, the tubular product (such as a copper tube) is put around the periphery of the front end of the lower spindle 21 and between the mouth expanding convex ring 20 and the expanding concave wheel 33, so that the mouth expanding convex ring 20 and the expanding concave wheel 33 respectively clamp the outer wall and inner wall of the tube mouth of the tubular product (such as a copper tube). Then, the front end of the upper spindle 31 is adjusted downward to reduce the height, so as to tightly clamp the tubular product (such as a copper tube), and expand the tube mouth of the tubular product (such as a copper tube) outward to cause a deformation; At last, the driving device 4 drives the lower spindle 21 of the lower spindle module 2 to rotate. During rotation of the lower spindle 21, the first gear 22 works with the second gear 32 to drive the upper spindle 31 to rotate simultaneously. Thus, through the mouth expanding convex ring 20, the tube mouth of the tubular product (such as a copper tube) is pressed outward and into the mouth expanding groove 30 on the periphery of the expanding concave wheel 33. Consequently, the tube mouth is enlarged. After continuous rotation of the mouth expanding convex ring 20 and the expanding concave wheel 33, the tube mouth of the tubular product (such as a copper tube) is continuously squeezed, deformed and expanded, without damaging the tubular product. As the quality of the flaring is guaranteed, the present invention can meet the current manufacturing requirement. The simple structure and small size of the invention provide convenience for transportation and operation. Moreover, it has a good adaptability because it can be used for mouth expansion of tubular products of different sizes and models. The convenient usage of the multi-size adjustable mouth expanding device will make it very competitive in the market.

I claim:

1. A multi-size adjustable mouth expanding device, comprising:

a machine frame (1);

a lower spindle module (2), including a lower spindle (21) sleeved inside a lower part of the machine frame (1), and a first gear (22) sleeved on the lower spindle (21), wherein a front end and rear end of the lower spindle (21) are respectively extended out of a front end face and rear end face of the machine frame (1), and the periphery of a front end of the lower spindle (21) is configured with a mouth expanding convex ring (20) used to expand the tube mouth;

an upper spindle module (3) including an upper spindle (31), a second gear (32) sleeved on a periphery of the upper spindle (31) and meshed with the first gear (22), and an expanding concave wheel (33) installed on the front end of the upper spindle (31) and positioned out of the front end face of the machine frame (1), wherein a rear end of the upper spindle (31) is installed on the rear end of the machine frame (1) in a rotary form, the front end of the upper spindle (31) is installed on the front end of the machine frame (1) in a form that it can be displaced upward or downward, the periphery of the expanding concave wheel (33) is configured with a mouth expanding groove (30), the mouth expanding groove (30) is positioned above the mouth expanding convex ring (20);

a driving device (4) connected on a rear end of the lower spindle (21), and is used to drive the lower spindle (21) to rotate.

2. The multi-size adjustable mouth expanding device defined in claim 1, wherein the front and rear ends of the lower spindle (21) are respectively sleeved with a first spindle seat (23) and a second spindle seat (24), the first spindle seat (23) and second spindle seat (24) are both fixed inside the machine frame (1) through screws (25), and the lower spindle (21) can rotate both around the first spindle seat (23) and the second spindle seat (24).

3. The multi-size adjustable mouth expanding device defined in claim 1, wherein the mouth expanding convex ring (20) is integrally formed around the front end of the lower spindle (21).

4. The multi-size adjustable mouth expanding device defined in claim 2, wherein the front and rear ends of the upper spindle (31) are respectively sleeved with a third spindle seat (34) and a fourth spindle seat (35), specifically, the fourth spindle seat (35) is installed on the rear end of the machine frame (1) in a rotary form; the third spindle seat (34) is installed on the front end of the machine frame (1) through an adjusting module (37) in a form that it can be displaced upward or downward.

5. The multi-size adjustable mouth expanding device defined in claim 4, wherein the fourth spindle seat (35) is sleeved with a rotary shaft (351), and through the rotary shaft (351), it is installed on the rear end of the machine frame (1) in a rotary form.

6. The multi-size adjustable mouth expanding device defined in claim 4, wherein the adjusting module (37) comprises a threaded seat (371) fixed on the machine frame (1), an adjusting screw rod (372) spirally going through the threaded hole (301) of the threaded seat (371), an adjusting handle (373) fixed on the upper end of the adjusting screw rod (372), and a spring (374) configured between the lower end face of the third spindle seat (34) and the upper end face of the first spindle seat (23), under the elastic force of the spring (374), the third spindle seat (34) is lifted upward, and the lower end of the adjusting screw rod (372) is pressed on the upper end face of the third spindle seat (34).

7. The multi-size adjustable mouth expanding device defined in claim 6, wherein the spring (374) is a tower-shaped spring with its diameter increasing from top to bottom; the first spindle seat (23) is internally configured with a first copper sleeve (26); the lower spindle (21) is sleeved inside the first copper sleeve (26) and can rotate inside the first copper sleeve (26); the third spindle seat (34) is internally configured with a second copper sleeve (38); the upper spindle (31) is sleeved inside the second copper sleeve (38) and can rotate inside the second copper sleeve (38).

8. The multi-size adjustable mouth expanding device defined in claim 6, wherein the lower end face of the third spindle seat (34) is configured with a first groove body (341); the upper end face of the first spindle seat (23) is configured with a second groove body (231); the lower end of the spring (374) is embedded into the second groove body (231); the upper end of the spring (374) is embedded into the first groove body (341).

9. The multi-size adjustable mouth expanding device defined in claim 1, wherein the driving device (4) comprises a handle (41), the handle (41) is fixed on the rear end of the lower spindle (21), which can be turned manually to drive the lower spindle (21) to rotate; the lower end of the machine frame (1) is configured with a mounting board (11) protruding downward for fixed installation in the environment.

10. The multi-size adjustable mouth expanding device defined in claim 1, wherein the driving device (4) is a motor module, which electrically drives the lower spindle (21) to rotate; the lower end of the machine frame (1) is configured with a mounting board (11) protruding downward for fixed installation in the environment.

* * * * *